US010406421B2

(12) United States Patent
Faucette

(10) Patent No.: US 10,406,421 B2
(45) Date of Patent: Sep. 10, 2019

(54) GOLFING AID, TRAINING GOLF CLUB, AND TRAINING GOLF BALL

(71) Applicant: FIGHTING GOLF, LLC, Ashburn, VA (US)

(72) Inventor: Tiffany Faucette, Ashburn, VA (US)

(73) Assignee: Fighting Golf LLC, Ashburn, VA (US)

( * ) Notice: Subject to any disclaimer, the term of this patent is extended or adjusted under 35 U.S.C. 154(b) by 0 days.

(21) Appl. No.: 15/341,792

(22) Filed: Nov. 2, 2016

(65) Prior Publication Data

US 2017/0157487 A1 Jun. 8, 2017

Related U.S. Application Data

(60) Provisional application No. 62/262,187, filed on Dec. 2, 2015.

(51) Int. Cl.
*A63B 60/54* (2015.01)
*A63B 69/36* (2006.01)

(52) U.S. Cl.
CPC ..... *A63B 69/3617* (2013.01); *A63B 60/54* (2015.10); *A63B 2069/362* (2013.01); *A63B 2209/08* (2013.01); *A63B 2209/10* (2013.01)

(58) Field of Classification Search
CPC ..... A63B 69/3617; A63B 69/3685; A63B 69/3632; A63B 2209/10; A63B 69/3688; A63B 69/3638; A63B 69/36; A63B 2069/362; A63B 2209/08; A63B 60/54; Y10T 24/1394
USPC ..... 473/219–244; 150/160; 24/545, 563, 24/511, 67.9, 30.5 R; D8/395; D9/443
See application file for complete search history.

(56) References Cited

U.S. PATENT DOCUMENTS 1,464,029 A * 8/1923 Coughtrie ..... A63B 69/3617 15/246
1,759,622 A * 5/1930 Kenney ..... A63B 69/3632 473/235
1,939,414 A * 12/1933 Sametz ..... A63B 69/3632 473/226
2,670,209 A * 2/1954 Fay ..... A63B 69/3685 33/286
3,175,827 A 3/1965 Livingood
3,343,842 A 9/1967 Woerner
3,398,961 A * 8/1968 Higdon ..... A63B 69/3638 473/242
3,401,941 A * 9/1968 Hesidence ..... A63B 69/3632 273/DIG. 30

(Continued)

*Primary Examiner* — Sebastiano Passaniti
(74) *Attorney, Agent, or Firm* — Buchanan Ingersoll & Rooney PC

(57) ABSTRACT

A club mountable golfing aid is operable to indicate to a golfer a location at which a training golf ball contacts a striking surface of the club mountable golfing aid when the club mountable golfing aid is mounted on a golf club. The club mountable golfing aid includes an attachment mechanism that is configured to mount the club mountable golfing aid to a head of a golf club. The club mountable golfing aid includes the striking surface. The striking surface covers at least a portion of the face of the golf club when the club mountable golfing aid is mounted on the head of the golf club. The striking surface is operable to attach to and retain a training golf ball at about a point of contact between the striking surface and the training golf ball when a golfer strikes the ball.

25 Claims, 8 Drawing Sheets

(56) References Cited

U.S. PATENT DOCUMENTS 3,489,415 A * 1/1970 Smith ..... A63B 69/3685 473/236
3,721,447 A * 3/1973 Louderback ..... A63B 69/3632 24/442
3,870,316 A * 3/1975 DeBrocke ..... A63B 69/3632 473/235
4,149,726 A * 4/1979 Tredway, Sr. ..... A63B 69/3632 473/235
5,082,284 A * 1/1992 Reed ..... A63B 69/3632 273/DIG. 30
5,181,723 A * 1/1993 Brown ..... A63B 69/3632 273/DIG. 30
5,230,512 A * 7/1993 Tattershall ..... A63B 69/3614 273/DIG. 30
5,482,282 A * 1/1996 Willis ..... A63B 53/04 473/342
5,484,146 A * 1/1996 Loschiavo ..... A63B 69/0024 473/334
5,599,240 A 2/1997 Feldmeier
5,609,530 A * 3/1997 Butler, Jr. ..... A63B 69/3617 473/237
5,702,309 A * 12/1997 Lee ..... A63B 24/0021 473/235
5,782,701 A * 7/1998 O'Bryan ..... A63B 69/3655 273/DIG. 30
5,947,832 A 9/1999 Gagne
6,231,452 B1 * 5/2001 Novosel, Sr. ..... A63B 53/007 124/3
6,899,634 B2 * 5/2005 Hull ..... A63B 69/3617 473/226
6,926,629 B2 * 8/2005 Dehen ..... A47L 13/00 119/867
7,086,956 B2 * 8/2006 Matthews ..... A63B 69/3617 273/DIG. 30
7,261,653 B2 8/2007 Thornburg et al.
7,347,790 B2 * 3/2008 Zimmerman ..... A63B 69/3632 273/DIG. 30
7,361,097 B2 * 4/2008 Hot ..... A63B 60/62 150/160
7,431,661 B1 10/2008 Cailey
7,722,473 B1 5/2010 Shah
7,758,438 B1 7/2010 Colomberti
7,892,110 B2 * 2/2011 Bertolino, Jr. ..... A63B 69/3623 473/226
8,342,979 B2 * 1/2013 Kaufman ..... A63B 69/3632 473/224
8,617,006 B2 * 12/2013 VanDelden ..... A63B 24/0021 473/409
2003/0176228 A1 * 9/2003 Santa Cruz ..... A63B 43/005 473/235
2009/0118027 A1 5/2009 Safstrom
2010/0248854 A1 * 9/2010 Cannon, Jr. ..... A63B 69/3632 473/241
2013/0130820 A1 * 5/2013 Parks ..... A63B 69/36 473/235
2014/0094329 A1 * 4/2014 Taylor ..... A63B 69/0026 473/563

* cited by examiner

GOLFING AID, TRAINING GOLF CLUB, AND TRAINING GOLF BALL

This application claims priority to U.S. Provisional Application No. 62/262,187, which is entitled "GOLFING AID, TRAINING GOLF CLUB, AND TRAINING GOLF BALL," and was filed on Dec. 2, 2015, the entire contents of which are hereby incorporated by reference herein.

FIELD OF THE INVENTION

This invention pertains to golf aids, and may find particular use in golf aids that may be mounted on a head of a golf club, training golf clubs, and training golf balls.

BACKGROUND

Golf is a complex sport that involves a summation of human movement and forces prior to, during, and after ball contact. Golf aids can help a golfer improve their game. Some devices vary tremendously, while others have only minor variations that separate them; therefore, even subtle differences can make a large difference in a complex series of alignments and movements involved in every golf stroke. Furthermore, inclement weather or time constraints may reduce the available time a golfer has to practice outdoors. Thus, there is a need for a golf aid that can be used indoors and train a golfer to accurately strike a golf ball.

SUMMARY

Disclosed herein is a club mountable golfing aid operable to indicate to a golfer a location at which a training golf ball contacts a striking surface of the club mountable golfing aid that overlies a face of a golf club when a golfer strikes the training golf ball such that a golfer can train to accurately strike a golf ball. The club mountable golfing aid includes an attachment mechanism configured to mount the club mountable golfing aid to a head of a golf club. The club mountable golfing aid includes the striking surface. The striking surface covers at least a portion of the face of the golf club when the club mountable golfing aid is mounted on the head of the golf club. The striking surface is operable to attach to, and retain a training golf ball at about a point of contact between the striking surface and the training golf ball when a golfer strikes the training golf ball.

Also disclosed herein is a training club head of a training golf club operable to indicate to a golfer a location at which a training golf ball contacts a striking surface of the training club head of the training golf club when a golfer strikes the training golf ball. The training club head includes a face, a hosel, a back, and a sole. The training club head is attachable or integral to a training golf club that includes a grip and a shaft. The training club head of the training golf club includes the striking surface that covers at least a portion of the face of the training club head. The striking surface is operable to attach to, and retain, a training golf ball at about a point of contact between the striking surface and the training golf ball when a golfer strikes the training golf ball.

Further disclosed herein is a training golf ball configured to attach to a striking surface of a training golf club when a golfer strikes the training golf ball. The training golf ball includes an outer surface. The training golf ball is configured to attach to a striking surface of a training golf club such that a portion of the outer surface of the training golf ball remains in contact with the striking surface at about a point of contact between the striking surface and the training golf ball.

BRIEF DESCRIPTION OF THE DRAWING FIGURES

DETAILED DESCRIPTION

Figure 1:
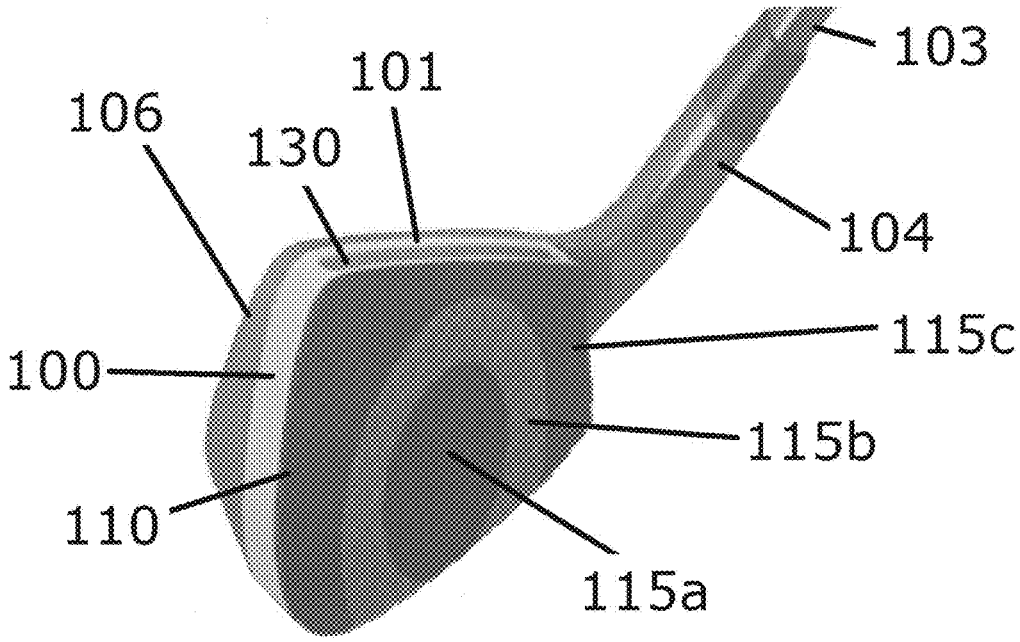
FIG. 1 illustrates an embodiment of a club mountable golfing aid mounted on a club head according to an embodiment as disclosed herein.

In the following detailed description, numerous specific embodiments are set forth in order to provide a thorough understanding of the club mountable golfing aid, training golf club, training golf ball, and methods disclosed herein. However, as will be apparent to those skilled in the art, the present embodiments may be practiced without these specific details or by using alternate elements or processes. In other instances, well-known processes, procedures, and/or components have not been described in detail so as not to unnecessarily obscure aspects of embodiments disclosed herein. As used herein, the terms "swing" and "stroke" may refer to a putting stroke, a partial swing, chipping stroke, or a full swing. As used herein, the terminology "at about a point of contact", when used in conjunction with embodiments as disclosed herein, refers to an area on the striking surface having a radius of less than 20 mm from an initial contact point between the striking surface and a training golf ball. As used herein, a training golf club may refer to a traditional golf club that includes a club mountable golfing aid mounted thereon or a training golf club that includes an integral or removable training golf head. Like numerals in the figures refer to like elements of present embodiments as disclosed herein.

As indicated, present embodiments provide a club mountable golfing aid ("golfing aid"), training golf club, and training golf ball that are operable to aid in training a golfer accurately strike a training golf ball indoors or outdoors, and thereby train a golfer to accurately strike a golf ball. Embodiments of a club mountable golfing aid as disclosed herein are operable to indicate to a golfer where a training golf ball contacts a striking surface of a training golf club or a striking surface of a club mountable golfing aid overlying a face of a traditional golf club when a golfer strikes the training golf ball because the training golf ball attaches to, and is retained by the striking surface of the training golf club or the striking surface of the club mountable golfing aid. Thus, a golfer can repeatedly strike the training golf ball without being required to retrieve the training golf ball. In this manner, a golfer can improve the mechanics of his or her swing indoors or outdoors, and without being required to purchase a bucket of balls at a driving range or retrieve a struck golf ball.

The club mountable golfing aid includes an attachment mechanism configured to mount the club mountable golfing aid to a head of a golf club. Embodiments of the club mountable golfing aid and training golf clubs as disclosed herein can be mounted on a putter, irons, hybrids, woods, or drivers. The club mountable golfing aid includes a striking surface. The striking surface covers at least a portion of the face of the golf club when the club mountable golfing aid is mounted on the head of the golf club. The striking surface is operable to attach to and retain a training golf ball at about a point of contact between the striking surface and the training golf ball when a golfer strikes the ball such that a golfer can determine a location at which the striking surface contacts the training golf ball. Because the striking surface preferably has the same or substantially the same pitch and/or area as the face of a respective golf club to which it is mounted, a golfer can determine where on the face of the golf club a golf ball would have been struck. This allows a golfer to determine whether a golf ball has been accurately hit, and also allows a golfer to practice accurately striking a golf ball without the need for a driving range or a net into which the golfer may hit a ball, which must then be retrieved.

Embodiments of a training golf club as disclosed herein are operable to indicate to a golfer where a training golf ball contacts a striking surface overlying a face of the golf club when a golfer strikes the training golf ball because a portion of an outer surface of the training golf ball remains in contact with the striking surface at about a point of contact between the striking surface and the training golf ball. The training golf club can include a grip, a shaft, and a training club head including a face, hosel, back, and sole. The training golf club includes a striking surface that covers at least a portion of the face of the golf club. The striking surface is operable to attach to a training golf ball at about a point of contact between the striking surface and the training golf ball when a golfer strikes the ball such that a golfer can determine where on the striking surface the golfer struck the training golf ball. This allows a golfer to determine whether a golf ball has been accurately hit, and also allows a golfer to practice accurately striking a golf ball without the need for a driving range or a net into which the golfer may hit a ball, which must then be retrieved. Embodiments of the training golf clubs as disclosed herein can include a putter, irons, woods, hybrids, or drivers.

The club mountable golfing aid and training golf club can allow a golfer to determine about where (i.e. about a point of contact between the striking surface and the golf ball) a training golf ball contacts a striking surface of the club mountable golfing aid or training golf club. More preferably, the club mountable golfing aid and training golf club can allow a golfer to know where a training golf ball hits a striking surface of the club mountable golfing aid or training golf club within a radius of less than about 15 mm, less than about 10 mm, less than about 5 mm, or less than about 2 mm from an initial contact point between the striking surface and a training golf ball when the golfer strikes the training golf ball with the embodiments of the club mountable golfing aid attached to a traditional golf club or embodiments of the training golf club that include a training club head. Most preferably, a golfer can determine the exact contact point between the striking surface and the training golf ball. In this manner, a golfer can determine whether he or she has accurately struck a training golf ball and work to recreate movements that have led to the training golf ball being accurately struck.

In an embodiment, the striking surface of the club mountable golfing aid or training golf club covers the entire face of the golf club when the club mountable golfing aid is mounted on the head of the golf club or the entire face of the training golf club. In an embodiment, the striking surface of the club mountable golfing aid or training golf club covers at least a portion of a sole and/or hosel of the head of the golf club when the club mountable golfing aid is mounted on the head of the golf club or at least a portion of a sole and/or hosel of the training club head of the training golf club. In this embodiment, because the striking surface is operable to attach to a training golf ball, the training ball will attach to the striking surface even if the training golf ball is mis-hit, such as when a golfer hits the training golf ball with the sole or hosel of the golf club to which the club mountable golfing aid is mounted or the sole or hosel of the training club head of the training golf club.

In an embodiment, the striking surface of the club mountable golfing aid or training golf club can include at least two zones which are visible to a golfer. Preferably the striking surface of the club mountable golfing aid or training golf club includes at least three zones which are visible to a golfer. Each zone is arranged on a different portion of the striking surface to indicate to a golfer a quality of contact between the striking surface and a training golf ball when a golfer strikes the training golf ball such that the golf ball attaches to the striking surface. Preferably, at least one zone on the striking surface indicates the sweet spot on the club face underlying the club mountable golfing aid, or the sweet spot of the training golf aid such that when a golfer accurately strikes the training golf ball, the training golf ball attaches to the striking surface, and a portion of the outer surface remains in contact with the striking surface within the zone that indicates the sweet spot. One or more zones can surround the zone which indicates the sweet spot wherein if a golfer does not accurately strike the training golf ball, the training golf ball will attach to a zone surrounding the sweet spot zone and a golfer can thereby determine that the training golf ball was not accurately struck. Thus, a golfer can determine whether he or she is accurately striking the training golf ball by determining which zone the training golf ball is in when the training golf ball attaches to the striking surface. In an embodiment, each zone can have its own color. For example, a green colored zone can indicate the sweet spot of the striking surface, a yellow zone can directly surround the green zone to indicate when a golfer struck near the sweet spot, and a red zone can surround the yellow zone to indicate that a golfer mis-hit the training golf ball.

In an embodiment, the striking surface of the club mountable golfing aid or training golf club can attach to a training golf ball via hook and loop fasteners (e.g., Velcro™ hook and loop fasteners). For example, the striking surface of the club mountable golfing aid or the training club head of the training golf club can include a plurality of hooks thereover. The plurality of hooks are configured to attach to a plurality of loops on an outer surface of a training golf ball such that when a golfer strikes the training golf ball, a portion of the plurality of hooks fasten to a portion of the plurality of loops, and training golf ball attaches to the striking surface at about the point of contact between the striking surface and the golf ball. Alternatively, in an embodiment, the striking surface of the club mountable golfing aid or training golf club can include a plurality of loops thereover. The plurality of loops are configured to attach to a plurality of hooks on a training golf ball such that when a golfer strikes the golf ball, a portion of the plurality of hooks fasten to a portion of the plurality of loops, and the golf ball attaches to the striking surface at about the point of contact between the striking surface and the golf ball. In a further embodiment, the striking surface of the club mountable golfing aid or training golf club can include a plurality of hooks thereover and the training golf ball can include a plurality of hooks therearound. The plurality of hooks of the striking surface and the training golf ball are operable to attach at about the point of contact between the striking surface and the golf ball when a golfer strikes the training golf ball. In an alternate embodiment, the striking surface of the club mountable golfing aid or training golf club can include at least one magnet thereunder. In this embodiment, the at least one magnet is configured to attach to a training golf ball that includes an oppositely charged magnet therein such that when a golfer strikes the training golf ball, the training golf ball attaches to the striking surface at about the point of contact between the striking surface and the training golf ball.

In an embodiment, the club mountable golfing aid or the training golf club can include a shock absorber beneath the striking surface such that when a golfer strikes the training golf ball the impact between the striking surface and the golf ball is reduced. Preferably, the shock absorber absorbs or disperses kinetic energy at the impact point between the striking surface and the training golf ball. In an embodiment, the shock absorber can be formed by removing an internal portion of the club mountable golfing aid or an internal portion of the head of the training golf club beneath the striking surface such that the striking surface gives when the training golf ball is struck. In an alternate embodiment, the striking surface can be formed from a soft material which depresses when the training golf ball is struck, or a soft material can underlie a harder striking surface wherein the soft material depresses when the training golf ball is struck.

In an embodiment, the attachment mechanism of the club mountable golfing aid is a stretchable material that can be stretched over a portion of the head of the golf club when the club mountable golfing aid is mounted on the head of the golf club wherein the stretchable material secures the club mountable golfing aid to the head of the golf club. In an embodiment, the stretchable material can be configured such that it surrounds a portion of a hosel of the golf club to which the club mountable golfing club is mounted. In an alternate embodiment, the attachment mechanism of club mountable golfing aid can include at least one strap that is operable to secure the club mountable golfing aid to the head of the golf club. In this embodiment, the at least one strap can loop around the back of the club head so as to secure the club mountable golfing aid to the head of the golf club. The at least one strap can be at least one tie-able strap, at least one elastic strap, or at least one strap having hook and loop fasteners (e.g., Velcro™ hook and loop fasteners). The attachment mechanism can also include at least one hosel strap that is operable to secure the club mountable golfing aid to the hosel of the golf club when the club mountable golfing aid is mounted on the head of the golf club. The at least one hosel strap can be at least one tie-able strap, at least one elastic strap, or at least one strap having hook and loop fasteners (e.g., Velcro™ hook and loop fasteners). In an embodiment, the attachment mechanism of the club mountable golfing aid can include at least one clip that secures the club mountable golfing aid to the head of the golf club. In an embodiment, the attachment mechanism of the club mountable golfing aid can include at least one magnet. The at least one magnet is operable to magnetically attach the club mountable golfing aid to the face of a golf club. In an embodiment, the attachment mechanism of the club mountable golfing aid can include at least one clip and at least one magnet.

FIG. 1 illustrates an embodiment of a club mountable golfing aid 100 that is attached to a club head 106 of a traditional golf club. As illustrated, the traditional golf club also includes a shaft 103 and hosel 104. The club mountable golfing aid 100 includes a magnetic attachment mechanism 101 that is operable to magnetically attach the club mountable golfing aid 100 to the face of the club head 106. To attach this embodiment of the club mountable golfing aid 100 to the face of the golf head 106, a golfer contacts a back surface of the club mountable golfing aid 100 opposite the striking surface 110 to the face of the golf head 106. In an embodiment, the magnetic attachment mechanism 101 can function to attract and attach a training golf ball that includes an oppositely charged magnet therein to the striking surface 110 when the golfer strikes the oppositely charged, magnetized training golf ball. In an embodiment, the club mountable golfing aid 100 can also include at least one additional magnet therein, beneath the striking surface 110 thereof, wherein the at least one magnet is operable to attach the oppositely charged, magnetized training golf ball to the striking surface 110. Therefore, when the club mountable golfing aid 100 is mounted on the head of the golf club and a golfer strikes the magnetized training golf ball, the training golf ball will attach to the striking surface at about the point of contact between the striking surface 110 and the training golf ball. Preferably, the club mountable golfing aid 100 includes a plurality of magnets therein such that the magnetized training golf ball will attach to a portion of the striking surface 110 directly over one of the plurality of magnets that is closest to the point of contact between the striking surface 110 and the magnetized training golf ball. Preferably the magnets are rare earth magnets, such as neodymium magnets.

The club mountable golfing aid 100 also includes the striking surface 100 which can have a visible first zone 115*a* that indicates the sweet spot of the underlying face of the club head 106. The striking surface 110 can also include a visible second zone 115*b* that surrounds the visible first zone 115*b*, and a visible third zone 115*c* that surrounds the visible second zone 115*b*. When a golfer strikes a training golf ball with the striking surface 110 of the club mountable golfing aid 100, the training golf ball will attach to the striking surface 110 within one of the visible first, second, or third zones 115*a*, 115*b*, 115*c* such that a golfer can determine how accurately he or she struck the training golf ball. The club mountable golfing aid 100 also includes a shock absorber 130 that is a cut-out (i.e. removed portion) extending through the entire club mountable golfing aid 100. The shock absorber 130 preferably disperses or absorbs kinetic energy when the striking surface 110 contacts the training golf ball such that the training golf ball may more readily attach to the striking surface 110.

Figure 2:
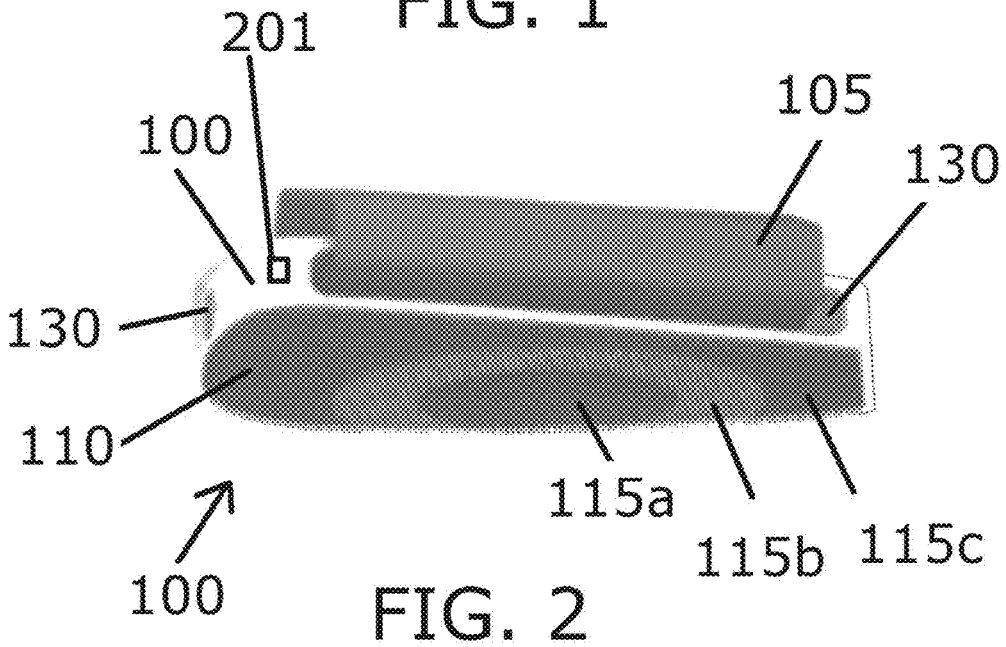
FIG. 2 illustrates an embodiment of a club mountable golfing aid according to an embodiment as disclosed herein.

FIG. 2 illustrates an embodiment of a club mountable golfing aid 100 including similar features as shown in FIG. 1. However, rather than a magnetic attachment mechanism (see FIG. 1), the club mountable golfing aid 100 includes a stretchable attachment mechanism 105 formed of a stretchable material, such as stretchable fabric or an elastomeric material. The stretchable material of the stretchable attachment mechanism 105 is operable to stretch over a portion of the head of a golf club when the club mountable golfing aid 100 is mounted on the head of the golf club such that the club mountable golfing aid 100 may be secured to the head of the golf club. The club mountable golfing aid 100 can include a logo (not shown) on a visible portion thereof. The club mountable golfing aid 100 can also include a shock absorber 130 that is a cut-out (i.e. removed portion) extending through the entire club mountable golfing aid 100. In this embodiment, the striking surface 110 includes a plurality of hook or loop fasteners (e.g., Velcro™ hook and loop fasteners), operable to attach to respective hook or loop fasteners on the outer surface of the training golf ball. Preferably the respective hook and loop fasteners are able to withstand repeated impact. For example, the hook and loop fasteners may be P87S type Velcro™ hook and loop fasteners or the like.

Figure 3:
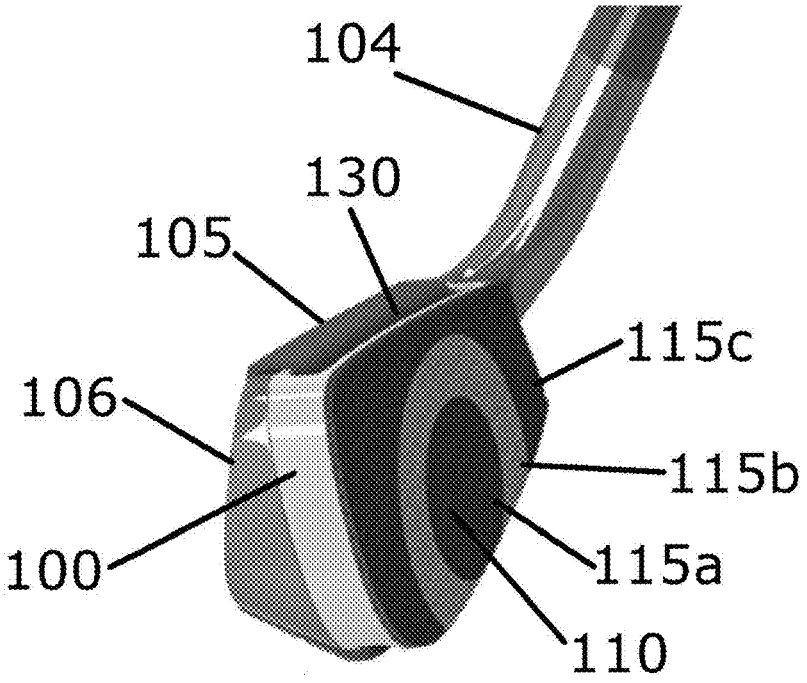
FIG. 3 illustrates an embodiment of a club mountable golfing aid mounted on a club head according to an embodiment as disclosed herein.
Figure 4:
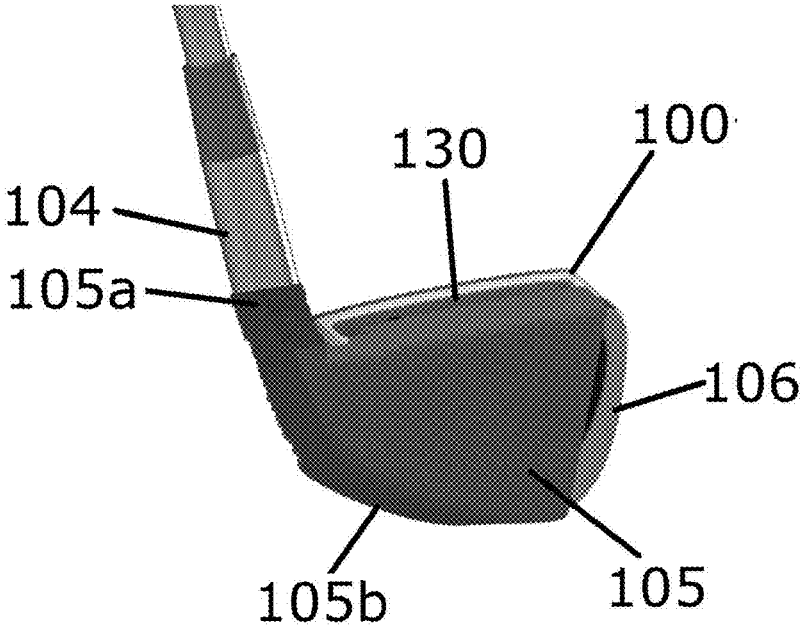
FIG. 4 illustrates an embodiment of a club mountable golfing aid mounted on a club head according to an embodiment as disclosed herein.

FIG. 3 shows an embodiment of a club mountable golfing aid 100 mounted on a club head 106 with a stretchable attachment mechanism 105. The club mountable golfing aid 100 can be installed on the head of a golf club by stretching the stretchable material around the back of the club head such that the surface of the club mountable golfing aid 100 opposite the striking surface 110 contacts the face of the club head. In an embodiment, the surface of the club mountable golfing aid 100 which contacts the face of the club head can include a layer of material or a coating thereon that increases the coefficient of friction between the club face and the surface of the club mountable golfing aid 100 that contacts the club face. As shown in FIG. 4 the stretchable attachment mechanism 105 can include a sleeve 105*a* of stretchable material that stretches over a portion of a hosel 104 of the golf club when the club mountable golfing aid 100 is mounted on the head 106 of the golf club. The sleeve 105*a* can aid in securely mounting the club mountable golfing aid 100 to the club head 106. If the stretchable attachment mechanism 105 includes the sleeve 105*a*, then the club mountable golfing aid 100 can be mounted on the club head by inserting the grip end of a golf club into the stretchable attachment mechanism 105 and sliding the club mountable golfing aid 100 down to proper position on the club head 106. The stretchable attachment mechanism 105 can also include a guard 105*b* at a bottom portion thereof wherein the guard is operable to reduce impact between the golf head 106 and/or the club mountable golfing aid 100 and the ground when a golfer strikes a training golf ball. The guard 105*b* can allow a golfer to practice indoors without damaging his or her equipment, or surface upon which the training golf ball is located. In a further embodiment, the sleeve 105*a* and/or the guard 105*b* can form part of the striking surface to which the training golf ball will attach such that when a golfer mis-hits the training golf ball the golfer will not have to retrieve the ball.

Figure 5:
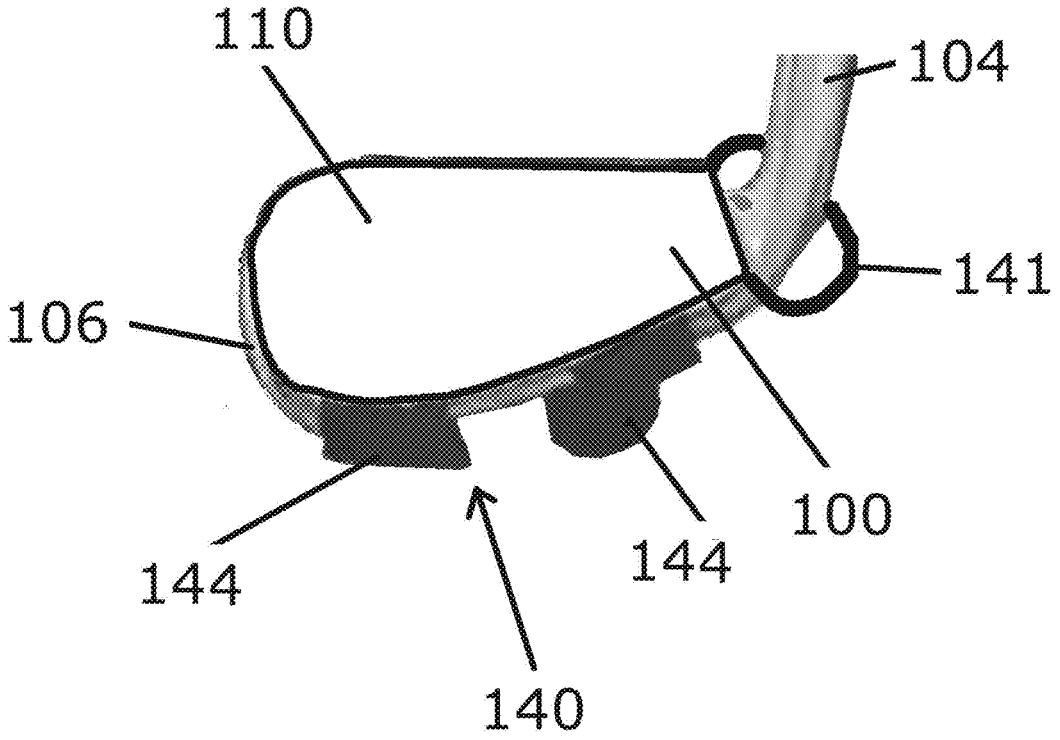
FIG. 5 illustrates an embodiment of a club mountable golfing aid mounted on a club head according to an embodiment as disclosed herein.

FIG. 5 illustrates an embodiment of a club mountable golfing aid 100 including similar features as shown in FIGS. 1-4. However, rather than a magnetic or stretchable attachment mechanism (see FIGS. 1-4), the club mountable golfing aid 100 includes a strap-able attachment mechanism 140 including two straps 144. In an alternate embodiment, one strap 144, or more than two straps 144 may be used. The straps 144 are operable to secure the club mountable golfing aid 100 to the head 106 of the golf club. As shown in FIG. 5, the straps 144 are straps having hook and loop fasteners, however in other embodiments the straps may be tie-able straps or elastic straps. The strap-able attachment mechanism 140 also includes at least one hosel strap, such as hosel strap 141 operable to secure the club mountable golfing aid 100 to the hosel 104 of the golf club. The hosel strap 141 illustrated in FIG. 5 is a tie-able strap that is in a loosened position. However in alternate embodiments, the hosel strap 141 may be an elastic strap or a strap having hook and loop fasteners.

Figure 6:
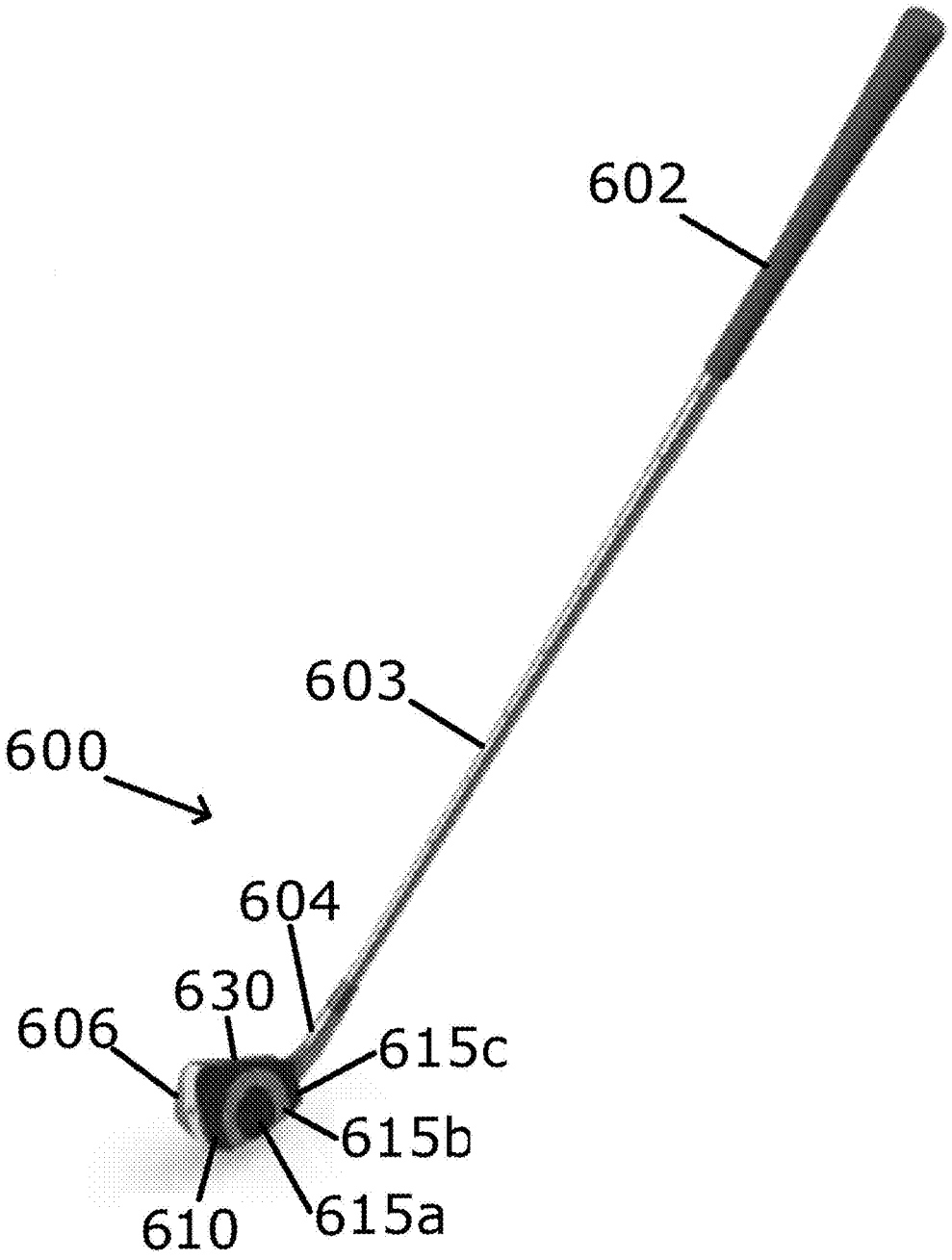
FIG. 6 illustrates an embodiment of a training golf club including a training club head according to an embodiment as disclosed herein.

FIG. 6 illustrates an embodiment of a training golf club 600 according to embodiments disclosed herein. The training golf club 600 includes a training club head 606 that is operable to indicate to a golfer where a training golf ball contacts a striking surface formed on at least a portion of the face of the training golf club 600 when a golfer strikes the training golf ball. The training golf club 600 includes a grip 602, a shaft 603, and the training club head 606 including the face, a hosel 604, a back, and a sole. A striking surface 610 covers at least a portion of the face of the training golf club 600. Preferably, the striking surface 610 covers the entire face and a portion of the hosel 604 and sole of the training club head 606. The striking surface 610 is operable to attach to a training golf ball at about a point of contact between the striking surface 610 and the training golf ball when a golfer strikes the ball.

The training golf club 600 can provide all of the training features and components/elements of embodiments of the club mountable golf aids as disclosed herein, however, the striking surface 610 of the training golf aid is not removeable from the training club head 606. Rather, in an embodiment, the training club head 606 of the training golf club 600 can be removed from a shaft 603 at a hosel 604 such that a different training club head 606 may then be secured to the shaft 603 for training. For example, a golfer may first practice with the training golf club 600 having the training club head of a pitching wedge. After a time, the golfer may then remove the training club head of the pitching wedge from the shaft 603, and then attach a training club head of any kind such as a nine iron, eight iron, or driver, etc. to the shaft 603 such that the golfer may then practice striking the training golf ball with the new training club head. The training club head 606 can be attached to the shaft 603 via a screw thread engagement or key and lock engagement. For a right handed golfer, the direction of the screw thread is preferably reversed such that the training club head 606 is not loosened when a golfer strikes the training golf ball. In an alternate embodiment, the training club head 606 may not be removable, but rather integral with the shaft 603.

In an embodiment, the club mountable golfing aids and training golf clubs as disclosed herein can include electronic functionality that can communicate with a golfer's cell phone via a cell phone application and blue tooth or the like. In this embodiment, the golf aid includes necessary electrical components such as a logic controller, rechargeable power source, radio transmitter, memory, and the like. For example, as shown in FIG. 2, the club mountable golfing aid 100 includes electrical components 201 that can communicate with a cell phone via blue tooth or other wireless technology such that the swing of a golfer, and the impact between a striking surface and the training golf ball can be analyzed. Preferably the electrical components 201 can be configured such that at least one of swing speed, impact force, carry distance, launch angle, and/or spin rate can be analyzed. In an embodiment, the entire path of the stroke can be mapped. For example, in an embodiment, the electrical components 201 can include a three axis accelerometer operable to transmit acceleration data to a programmed logic controller, and an optional three axis gyroscope operable to transmit angular velocity data to the logic controller. The logic controller can transmit the data, processed or unprocessed, to a cell phone or computer wherein a golfer may thereby receive swing feedback via a computer program or cell phone application. In a further embodiment, the electrical components 201 can include a three axis magnetometer operable to transmit directional orientation data to the logic controller. The electrical components 201 can also include a pressure gauge to determine the force at which the training golf ball is struck.

Figure 7:
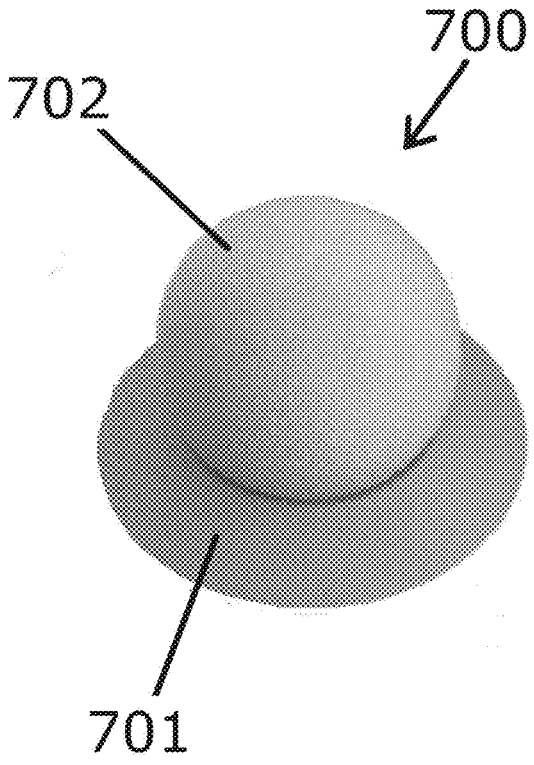
FIG. 7 illustrates an embodiment of a training golf ball according to an embodiment as disclosed herein.

FIG. 7 illustrates an embodiment of a training golf ball 700 and optional training tee 701 for use with the club mountable golfing aid 100 or training golf club 600. The training golf ball 700 can have a diameter of 40-50 mm and is made of a material, such as rubber or plastic, that can withstand repeated impact from the club mountable golfing aid 100 when mounted on a traditional golf club or training golf club 600. In an embodiment, the training golf ball 700 can have the same or about the same size and weight as a traditional golf ball. In an alternate embodiment, the training golf ball 700 can weigh substantially less than a traditional golf ball. The training golf ball 700 is operable to attach to a striking surface of a traditional golf club that includes the club mountable golfing aid 100 mounted thereon, or the training golf club 600 when the training golf ball 700 is struck. At this point, a golfer can determine where on the striking surface the training golf ball 700 was struck and then manually remove the training golf ball 700 from the striking surface.

Preferably the training golf ball 700 attaches to the striking surface via hook and loop fasteners (e.g., Velcro™ hook and loop fasteners). For example, the training golf ball 700 can include an outer surface 702 having a plurality of loops. When a golfer strikes the outer surface 702 of the training golf ball with a striking surface including a plurality of hooks, a portion of the plurality of loops engage with a portion of the plurality of hooks, and the training golf ball 700 attaches to the striking surface at about the point of contact between the striking surface and the outer surface 702 of the training golf ball 700. In an alternate embodiment, the outer surface 702 of the training golf ball 700 can include a plurality of hooks. When a golfer strikes the outer surface 702 of the training golf ball with a striking surface including a plurality of loops, a portion of the plurality of loops engage with a portion of the plurality of hooks, and the training golf ball 702 attaches to the striking surface at about the point of contact between the striking surface and the outer surface 702 of the training golf ball 700. In another embodiment, the outer surface 702 of the training golf ball 700 can include a plurality of hooks. When a golfer strikes the outer surface 702 of the training golf ball 700 with a striking surface including a plurality of hooks, a portion of the plurality of hooks of the training golf ball 700 engage with a portion of the plurality of hooks of the striking surface, and the training golf ball 700 attaches to the striking surface at about the point of contact between the striking surface and the outer surface 702 of the training golf ball 700.

In an alternate embodiment, the training golf ball 700 can includes at least one magnet therein. The at least one magnet is operable to attach to a striking surface of a training golf club that includes an oppositely charged magnet therein such that when a golfer strikes the training golf ball 700 the training golf ball attaches to the striking surface at about the point of contact between the striking surface and the training golf ball 700.

Figure 8:
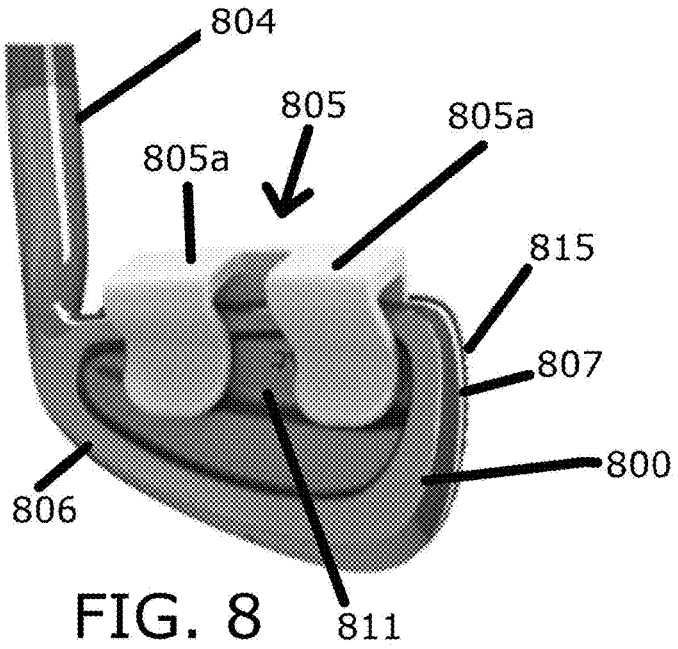
FIG. 8 illustrates an embodiment of a club mountable golfing aid mounted on a club head according to an embodiment as disclosed herein.
Figure 9:
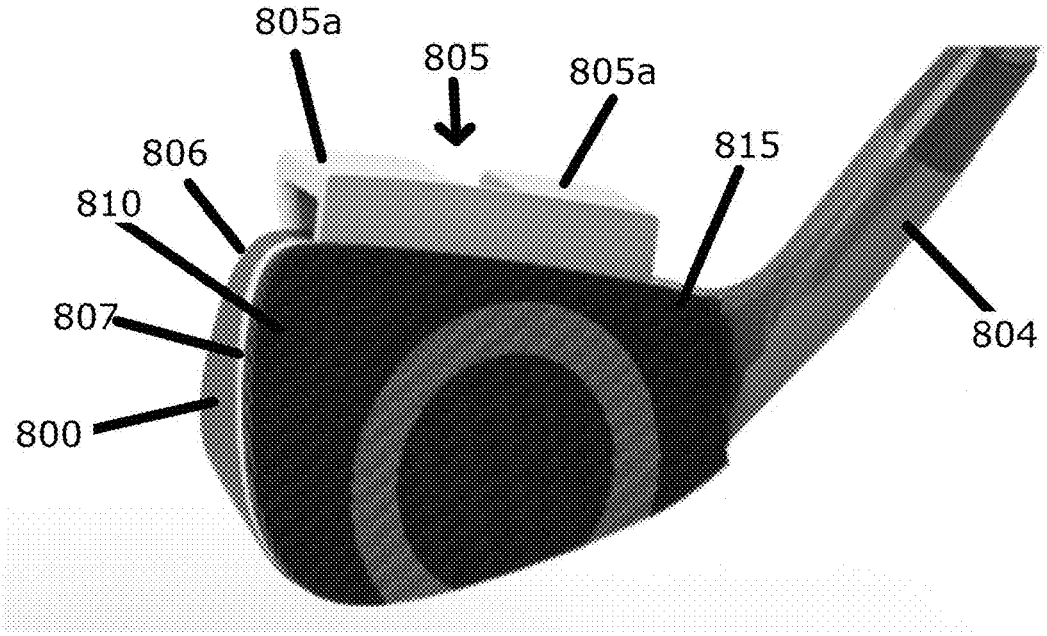
FIG. 9 illustrates an embodiment of a club mountable golfing aid mounted on a club head according to an embodiment as disclosed herein.

FIGS. 8 and 9 illustrate an embodiment of a club mountable golfing aid 800 mounted on a club head 806 having a hosel 804 according to an embodiment as disclosed herein. In this embodiment, the attachment mechanism 805 of the club mountable golfing aid 800 includes two clips 805*a* wherein the club mountable golfing aid 800 is attachable to the club head 806 with clips 805*a* that extend from an upper end of a face 807 of the club mountable golfing aid 800. When the club mountable golfing aid 800 is mounted on the club head 806, the clips 805*a* extend over an upper portion of the club head 806 and exert a force against a back 811 of the club head 806 such that a back surface of the face 807, opposite a striking face 810, contacts and lays flat against the face of the club head 806. Preferably, as shown in FIGS. 8 and 9, an outer periphery of the face 807, and the striking surface 810, have a similar profile, or the same profile as the club face of a club head 806 to which it is attached. In an alternative embodiment, the profile of the outer periphery of the face 807 and/or the striking surface 810 can be different than that of the face of a club head 806 to which it is attached. The face 807 is preferably a thin piece of material such that the thickness of the club head 806 is minimally increased. For example, the face 807 preferably has a thickness of about 0.1 inch or less, and more preferably the face has a thickness of about 0.08 inch. The face 807 and clips 805*a* of the club mountable golfing aid 800 can be formed from a single piece of resilient material such as a thermoplastic resin. Preferably, the face 807 and clips 805*a* of the club mountable golfing aid 800 are formed of Acrylonitrile Butadiene Styrene via injection molding.

In an embodiment, the back surface of the club mountable golfing aid 800 which contacts the face of the club head 806 can have a roughened surface, include a layer of material or a coating thereon that increases the coefficient of friction between the club face and the back surface of the club mountable golfing aid 800 that contacts the club face. In this embodiment, the striking surface 810 includes a plurality of hook or loop fasteners (e.g., Velcro™ hook and loop fasteners), operable to attach to respective hook or loop fasteners on the outer surface of a training golf ball. Preferably the respective hook and loop fasteners are able to withstand repeated impact. For example, the striking surface 810 can be an outer surface of a layer of material 815 that is adhered to the face 807 of the club mountable golfing aid 800 wherein the outer surface of the layer of material 815 includes a plurality of hook or loop fasteners. In an embodiment, the layer of material 815 can be a layer of P87S type Velcro™ hook and loop fasteners or the like.

Figure 10:
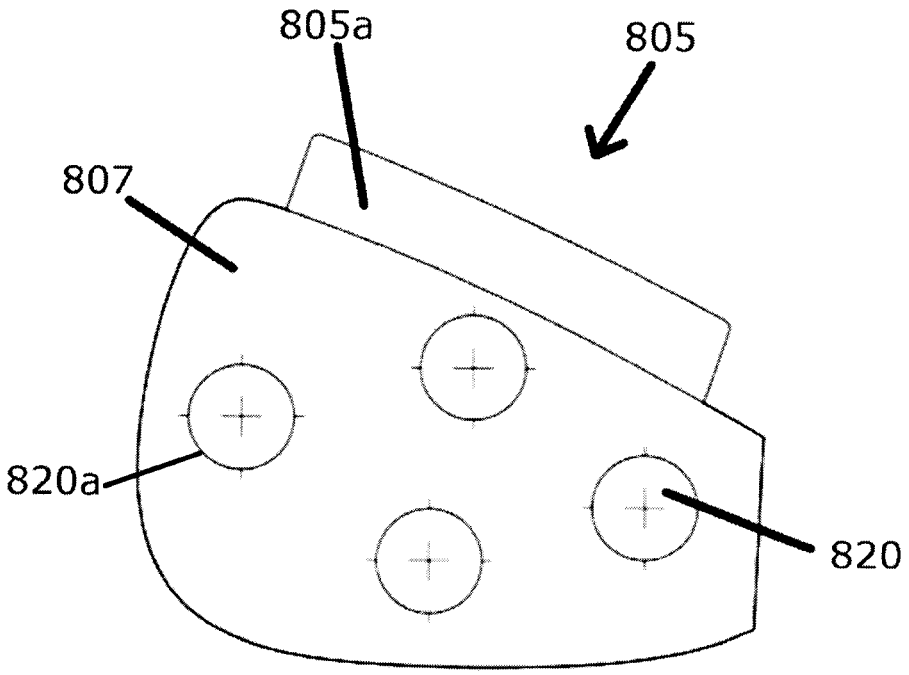
FIG. 10 illustrates an embodiment of a face of a club mountable golfing aid according to an embodiment as disclosed herein.

In an embodiment, an attachment mechanism of a club mountable golfing aid can include one or more magnets and one or more clips or straps wherein the one or more magnets and one or more clips or straps operate in conjunction to secure the club mountable golfing aid to a club head of a golf club. For example, FIG. 10 illustrates an embodiment of a face 807 of a club mountable golfing aid 800 according to an embodiment as disclosed herein. The face 807 includes an attachment mechanism 805 including a clip 805*a* integrally formed with the face 807 such that the club mountable golfing aid 800 may be mounted on a club head of a golf club. In an embodiment, the attachment mechanism 805 can include more than one clip 805*a* such as shown in FIGS. 8 and 9. The face 807 further includes four recesses 820 in an outer surface thereof wherein each recess is configured to receive a respective magnet therein, wherein the magnets are operable to secure the back surface of the face 807 against the club face of a club head. In an embodiment, the face 807 can include less than four recesses 820 and respective magnets 820*a*, or greater than four recesses 820 and respective magnets 820*a*. The recesses 820 are preferably formed in a surface of the face 807 to which a layer of material 815 having an outer surface comprising a plurality of hooks or looks is adhered to, such that the magnets 820*a* are sealed in the club mountable golfing aid. In an embodiment, the recesses have a diameter of about 0.5 inch and a depth of about 0.06 inch. Preferably the magnets 820*a* received by the recesses 820 are rare earth magnets, such as neodymium magnets.

Figure 11:
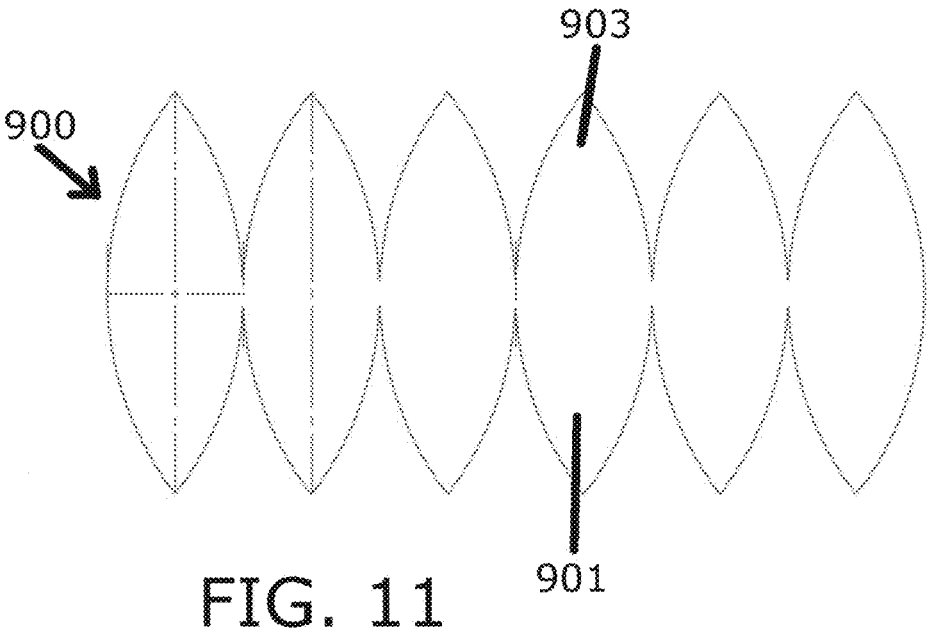
FIG. 11 illustrates an embodiment of an outer layer of a training golf ball according to an embodiment as disclosed herein.
Figure 12:
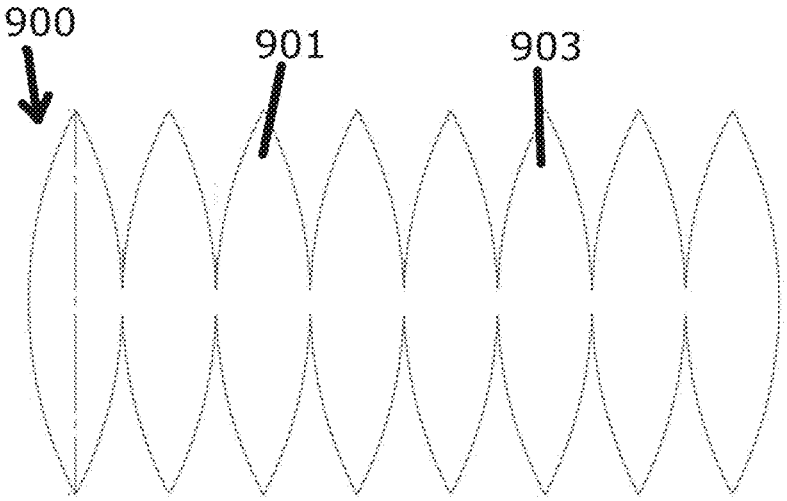
FIG. 12 illustrates an embodiment of an outer layer of a training golf ball according to an embodiment as disclosed herein.
Figure 13:
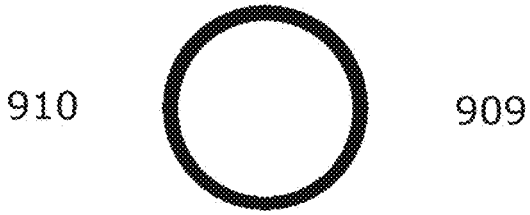
FIG. 13 illustrates an embodiment of a training ball core according to an embodiment as disclosed herein.

FIGS. 11 and 12 illustrate embodiments of respective outer layers 900 of training golf balls according to embodiments as disclosed herein. The respective outer layers 900 of the training golf balls include an outer surface 901 having a plurality of loops (e.g., Velcro™ hook and loop fasteners) such that the outer surface 901 is attachable to a striking surface of a club mountable golfing aid or training golf club having a surface of corresponding hooks (e.g., Velcro™ hook and loop fasteners). Alternatively, the respective outer layers 900 of the training golf balls include an outer surface 901 having a plurality of hooks such that the outer surface 901 is attachable to a striking surface of a club mountable golfing aid or training golf club having a surface of corresponding loops. To form the training golf balls, the inner surfaces of the respective outer layers 900 are adhered to respective outer surfaces 910 of a training ball cores 909 (see FIG. 13). In an embodiment, the training ball cores 909 are foam balls having dimensions similar to that of a golf ball. Alternatively, the training ball cores 909 can be formed of plastic, and are preferably hollow. Preferably, the training ball cores are slightly smaller than a golf ball such that when an outer surface 910 is adhered thereto, the training golf ball is about the size of a golf ball.

In an embodiment, each outer layer 900 is formed from a single piece of material including a plurality of fusiform segments 903 wherein adjacent fusiform segments are connected at about a midpoint between respective tapered ends of each fusiform segment. In an embodiment, the distance between respective tapered ends of each fusiform segment is about 50 to 70 mm. In an embodiment, an outer layer 900 can include between 4 and 20 fusiform segments wherein a length between outer midpoints of the respective end segments is about 100 to 140 mm. For example, as shown in FIG. 11, the outer layer 900 includes 5 fusiform segments. As shown in FIG. 12, the outer layer 900 includes 8 fusiform segments.

In an embodiment, a training golf ball can be formed by applying an adhesive to an inner surface of an outer layer 900 and/or an outer surface 910 of a training ball core 909, centering the outer layer 900 over an inlet orifice of a forming surface, and pushing the training ball core 909 through the orifice such that edges of the orifice cause the outer layer 900 to wrap around the training ball core 909 and adhere thereto. In an embodiment, the forming surface is a wall of a forming chamber, wherein the forming chamber includes a path therein that leads to an outlet orifice. In this embodiment, the path is shaped such that as the outer layer 900 and training ball core 909 travel along the path, a surface forming the path applies force to different portions of the outer layer 900 to thereby cause the outer layer 900 to adhere to further wrap around and adhere to the training ball core 909.

While the club mountable golfing aid, training golf club, and training golf ball have been described in detail with reference to specific embodiments thereof, it will be apparent to those skilled in the art that various changes and modifications can be made, and equivalents employed, without departing from the scope of the appended claims.

What is claimed:

1. A club mountable golfing aid operable to indicate to a golfer where a training golf ball contacts a striking surface overlying a face of a golf iron when a golfer strikes the training golf ball, the club mountable golfing aid comprising:

an attachment mechanism configured to mount the club mountable golfing aid to a head of a golf iron; and a face including a back surface and a striking surface, the striking surface covering at least a portion of the face of the golf iron when the club mountable golfing aid is mounted on the head of the golf iron, wherein the striking surface is operable to attach to a training golf ball at about a point of contact between the striking surface and the training golf ball when a golfer strikes the ball;

wherein the attachment mechanism includes two clips that extend from an upper end of the face of the club mountable golfing aid such that when the club mountable golfing aid is mounted on the head of the golf iron the clips extend over an upper portion of the head of the golf iron and exert a force against a back of the head such that the back surface of the face of the club mountable golfing aid lays flat against the face of the head of the golf iron;

wherein the face of the club mountable golfing aid includes at least one recess wherein the at least one recess includes a respective magnet therein that is configured to attach to a training golf ball that includes an oppositely charged magnet therein such that when the club mountable golfing aid is mounted on the head of the golf iron and a golfer strikes the training golf ball, the training golf ball attaches to the striking surface at about a point of contact between the striking surface and the training golf ball.

2. The club mountable golfing aid of claim 1, wherein the striking surface, when the striking surface is overlying a face of a golf iron, is configured to cover an entire area of an outer surface of the face of the golf iron.

3. The club mountable golfing aid of claim 1, wherein the attachment mechanism further comprises at least one magnet configured to magnetically attract the club mountable golfing aid to the face of the golf iron.

4. The club mountable golfing aid of claim 1, wherein the attachment mechanism further comprises a stretchable material, the stretchable material configured to stretch over a portion of the head of the golf iron when the club mountable golfing aid is mounted on the head of the golf iron.

5. The club mountable golfing aid of claim 4, wherein the stretchable material is configured to stretch over a portion of a hosel of the golf iron when the club mountable golfing aid is mounted on the head of the golf iron.

6. The club mountable golfing aid of claim 1, wherein the attachment mechanism comprises at least one strap, the at least one strap configured to secure the club mountable golfing aid to the head of the golf iron when the club mountable golfing aid is mounted on the head of the golf iron, wherein the at least one strap is at least one tie-able strap, at least one elastic strap, or at least one hook and loop fastener strap.

7. The club mountable golfing aid of claim 6, wherein the attachment mechanism further comprises at least one hosel strap configured to secure the club mountable golfing aid to the hosel of the golf iron when the club mountable golfing aid is mounted on the head of the golf iron, wherein the at least one hosel strap is at least one tie-able strap, at least one elastic strap, or at least one hook and loop fastener strap.

8. The club mountable golfing aid of claim 1, wherein the striking surface includes at least two zones which are visible to a golfer, wherein each zone is arranged on the striking surface to indicate to a golfer a quality of contact between the striking surface and a training golf ball when the club mountable golfing aid is mounted on the head of the golf iron and a golfer strikes a training golf ball such that the training golf ball attaches to the striking surface.

9. The club mountable golfing aid of claim 1, wherein the striking surface includes a plurality of hooks, the plurality of hooks configured to attach to a plurality of loops on a training golf ball such that when the club mountable golfing aid is mounted on the head of the golf iron and a golfer strikes the training golf ball the training golf ball attaches to the striking surface at about the point of contact between the striking surface and the training golf ball via both magnetic attachment and attachment of respective hooks and loops of the plurality of hooks and the plurality of loops.

10. The club mountable golfing aid of claim 1, wherein the club mountable golfing aid includes a shock absorber configured to absorb energy when the club mountable golfing aid is mounted on the head of the golf iron and a golfer strikes the training golf ball.

11. The club mountable golfing aid of claim 1, wherein the club mountable golfing aid includes electronic components, operable such that the swing of a golfer, and the impact between a striking surface and the training golf ball can be analyzed.

12. The club mountable golfing aid of claim 1, wherein the club mountable golfing aid includes a guard at a bottom portion thereof, the guard configured to reduce impact between the golf iron and the ground when the club mountable golfing aid is mounted on the head of the golf iron and a golfer strikes the training golf ball.

13. The club mountable golfing aid of claim 1, wherein the face of the club mountable golfing aid has a thickness between the striking surface and the back surface of about 0.1 inch or less.

14. The club mountable golfing aid of claim 13, wherein the face of the club mountable golfing aid has a thickness between the striking surface and the back surface of about 0.08 inch.

15. The club mountable golfing aid of claim 1, wherein the face of the club mountable golfing aid and the two clips are formed from a single piece of resilient material.

16. The club mountable golfing aid of claim 15, wherein the resilient material is acrylonitrile butadiene styrene.

17. The club mountable golfing aid of claim 1, wherein the striking surface includes a plurality of loops, the plurality of loops configured to attach to a plurality of hooks on a training golf ball such that when the club mountable golfing aid is mounted on the head of the golf iron and a golfer strikes the training golf ball, the training golf ball attaches to the striking surface at about the point of contact between the striking surface and the training golf ball via both magnetic attachment and attachment of respective hooks and loops of the plurality of hooks and the plurality of loops.

18. The club mountable golfing aid of claim 1, wherein the striking surface is an outer surface of a layer of material that is adhered to the face of the club mountable golfing aid, the outer surface including a plurality of loop elements or a plurality of hook elements.

19. The club mountable golfing aid of claim 1, wherein the back surface of the face of the club mountable golfing aid has a roughened surface.

20. A club mountable golfing aid for a golf iron, the club mountable golfing aid comprising:

a face including a back surface, a front surface, and at least one recess having a magnet therein, the front surface having a striking surface that covers at least a portion of the front surface, the striking surface operable to attach to a training golf ball at about a point of contact between the striking surface and the training golf ball when a golfer strikes the training golf ball;

wherein the back surface of the face of the club mountable golfing aid is configured to contact a face of a golf iron when the club mountable golfing aid is mounted on a golf iron;

wherein:

(a) the back surface of the face of the club mountable golfing aid has a roughened surface;

(b) the face of the club mountable golfing aid has a thickness between the striking surface and the back surface of about 0.1 inch or less;

(c) the club mountable golfing aid includes a guard at a bottom portion thereof;

(d) the face includes a shock absorber;

(e) the face includes electronic components operable to analyze the swing of a golfer; and (f) the face includes electronic components operable to analyze the impact between the striking surface and a training golf ball.

21. The club mountable golfing aid of claim 20, further comprising an attachment mechanism that comprises two clips that extend from an upper end of the face of the club mountable golfing aid.

22. The club mountable golfing aid of claim 21, wherein the two clips are configured to extend over an upper portion of the head of the golf iron and exert a force against a back of the head of the golf iron.

23. The club mountable golfing aid of claim 20, wherein the striking surface includes at least two zones that are arranged on the striking surface to indicate to a golfer a quality of contact between the striking surface and a training golf ball when the club mountable golfing aid is mounted on the head of the golf iron and a golfer strikes the training golf ball such that the training golf ball attaches to the striking surface.

24. The club mountable golfing aid of claim 20, wherein the striking surface includes a plurality of hooks, the plurality of hooks configured to attach to a plurality of loops on a training golf ball such that when the club mountable golfing aid is mounted on the head of the golf iron and a golfer strikes the training golf ball, the training golf ball attaches to the striking surface at about the point of contact between the striking surface and the training golf ball via both magnetic attachment and attachment of respective hooks and loops of the plurality of hooks and the plurality of loops.

25. The club mountable golfing aid of claim 20, wherein the striking surface includes a plurality of loops, the plurality of loops configured to attach to a plurality of hooks on a training golf ball such that when the club mountable golfing aid is mounted on the head of the golf iron and a golfer strikes the training golf ball, the training golf ball attaches to the striking surface at about the point of contact between the striking surface and the training golf ball via both magnetic attachment and attachment of respective hooks and loops of the plurality of hooks and the plurality of loops.

* * * * *